US005261827A

United States Patent [19]

Lenzi et al.

[11] Patent Number: 5,261,827

[45] Date of Patent: Nov. 16, 1993

[54] MOVABLE SHROUD CENTER STANDOFF

[75] Inventors: George Lenzi, Wheaton; Zbigniew Kabat, Chicago; Richard A. Walton, Carol Stream, all of Ill.

[73] Assignee: AG Communication Systems Corporation, Phoenix, Ariz.

[21] Appl. No.: 846,104

[22] Filed: Mar. 5, 1992

[51] Int. Cl.[5] ..... H01R 23/72

[52] U.S. Cl. ..... 439/78

[58] Field of Search ..... 439/55, 78, 571-573

[56] References Cited

U.S. PATENT DOCUMENTS 4,363,530 12/1982 Verhoeven ..... 439/557
4,753,601 6/1988 Cobaugh et al. ..... 439/559
5,158,469 10/1992 Martin ..... 439/78

*Primary Examiner*—Neil Abrams
*Attorney, Agent, or Firm*—Gregory G. Hendricks

[57] ABSTRACT

In order to accomplish the object of the present invention there is provided a movable standoff for maintaining a distance between a backplane and a shroud. Several receptacles are attached to the front side of the backplane and have pins that pass from the front side of the backplane to the rear side of the backplane. Additionally, the pins pass through the shroud. The movable standoff has an orifice extending from a first end to a second end. The pins of the receptacles pass through the orifice. The first end rests against the back side of the backplane, the shroud rests against the second end. Also, the second end of the movable standoff is smaller than the first end.

4 Claims, 4 Drawing Sheets

MOVABLE SHROUD CENTER STANDOFF

FIELD OF THE INVENTION

The present invention relates to interconnecting electronic circuits through a backplane arrangement. Specifically, the present invention is a plastic shroud center standoff used to provide support in an application where assemblies are attached to the rear of the backplane.

BACKGROUND OF THE INVENTION

Prior to the present invention, when there was a requirement to connect additional assemblies, such as cables, to the rear of a backplane, a shroud was placed over the backplane and the assembly was plugged into the shroud. This technique works well until a change to the backplane must be implemented. Such changes generally are applied through the addition of wires on the backplane. If the additional wires need access to the pins under the shroud, the shroud is removed, the wires are added, and the shroud is replaced.

The shroud must have standoffs that provide mechanical support while keeping a constant distance between the backplane and the shroud. The shroud may need additional mechanical support especially where a cable plugs into the shroud. However, adding additional pre-molded supports require the removal of a row of pins to make room for the supports. Additionally, if the cabling arrangement changed such that mechanical support was needed in a different place, the pre-molded supports could not be moved, and a new shroud would be required. Finally, with large systems containing several cabling arrangements, a unique shroud might be required for each such cabling arrangement.

Therefore, it is the objective of the present invention to provide a movable shroud standoff that allows the underlying pins to remain in place.

SUMMARY OF THE INVENTION

In order to accomplish the object of the present invention there is provided a movable standoff for maintaining a distance between a backplane and a shroud. The backplane has a front side and rear side. Several receptacles are attached to the front side of the backplane and have pins that pass from the front side of the backplane to the rear side of the backplane. Additionally, the pins pass through the shroud.

The movable standoff has a first end and a second end, where the second end is parallel to the first end and separated from the first end by the distance. The movable standoff has an orifice extending from the first end to the second end. The orifice has a longitudinal axis that is perpendicular to the first end and the second end of the movable standoff. The pins of the receptacles pass through the orifice. The first end rests against the back side of the backplane, the shroud rests against the second end. Also, the second end of the movable standoff is smaller than the first end.

DESCRIPTION OF THE DRAWINGS

A better understanding of the invention may be had from the consideration of the following detailed description taken in conjunction with the accompanying drawings, in which.

DESCRIPTION OF THE PREFERRED EMBODIMENT

Figure 1:
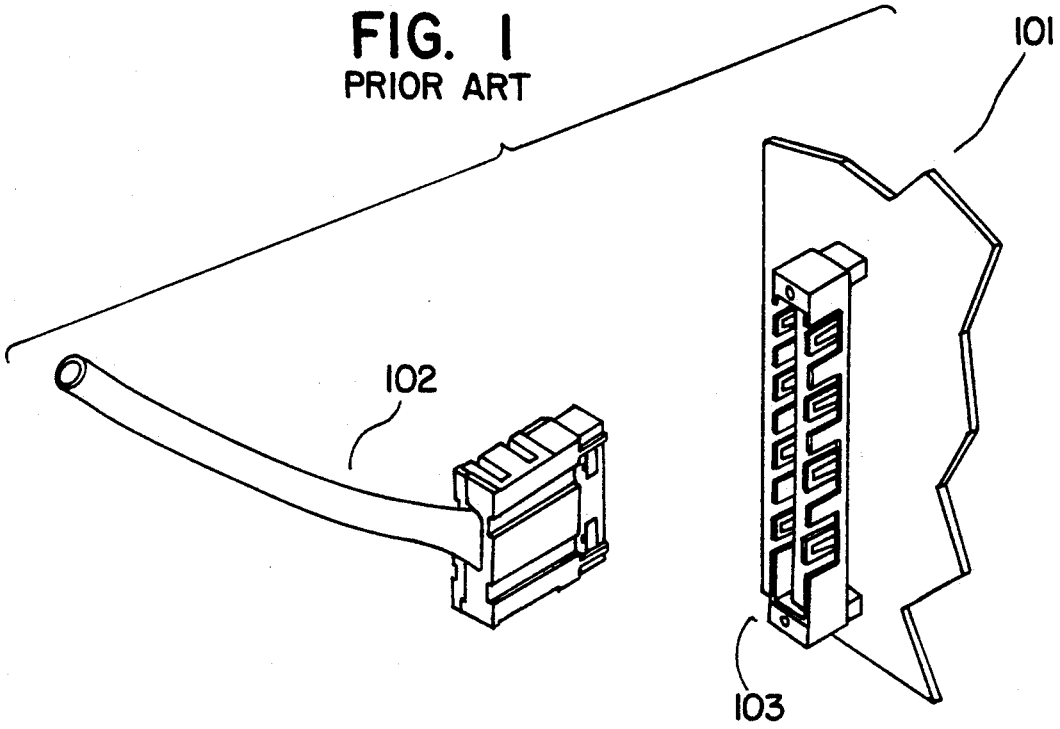
FIG. 1 PRIOR ART
FIG. 1 shows a backplane and cable shroud without the present invention.

FIG. 1 shows CABLE ASSEMBLY 101 lined-up in preparation to insertion into CABLE SHROUD 102. The CABLE SHROUD of FIG. 1 is shown without the use of the present invention. As CABLE ASSEMBLY 101 is inserted into CABLE SHROUD 101, the CABLE SHROUD 102 tends to flex allowing excessive travel of the CABLE ASSEMBLY 101 into the CABLE SHROUD 102. This excess travel may allow the pins of CABLE SHROUD 102 to seat too deeply, causing damage to the CABLE ASSEMBLY 101. Shown in FIG. 1, CABLE SHROUD 103 has a total of two standoffs, one on each end. The two standoffs and the cable shroud are molded simultaneously, making them a single unit.

Figure 2:
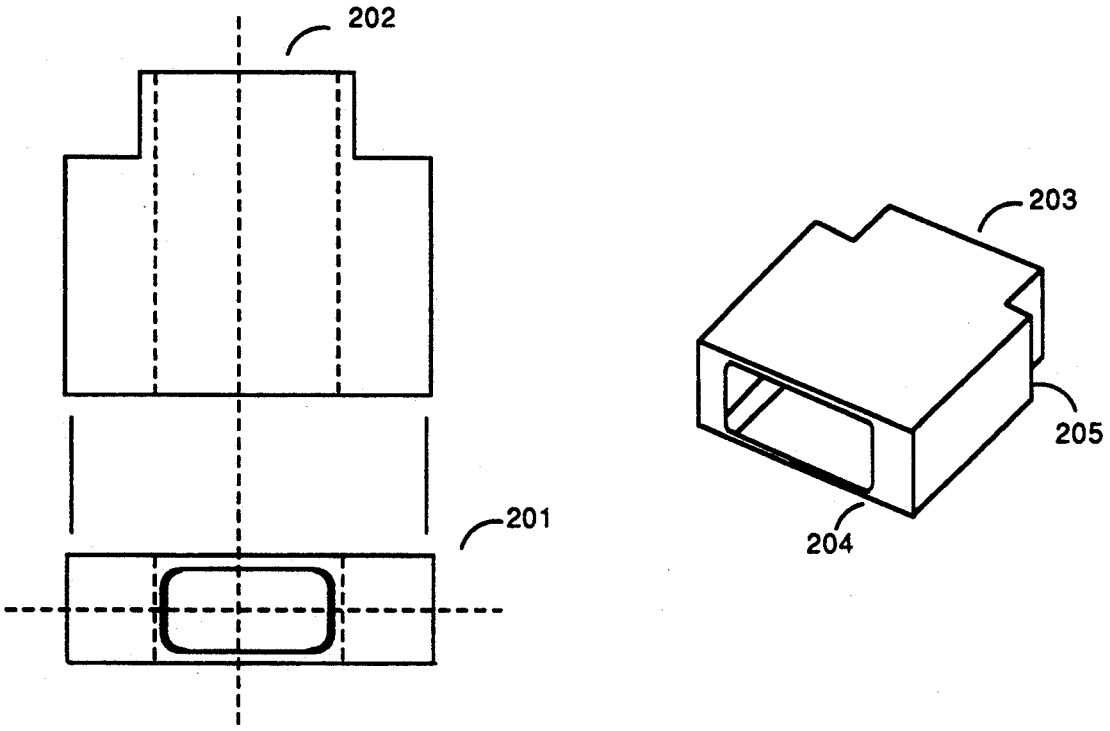
FIG. 2 is a pictorial representation of the present invention.
Figure 3:
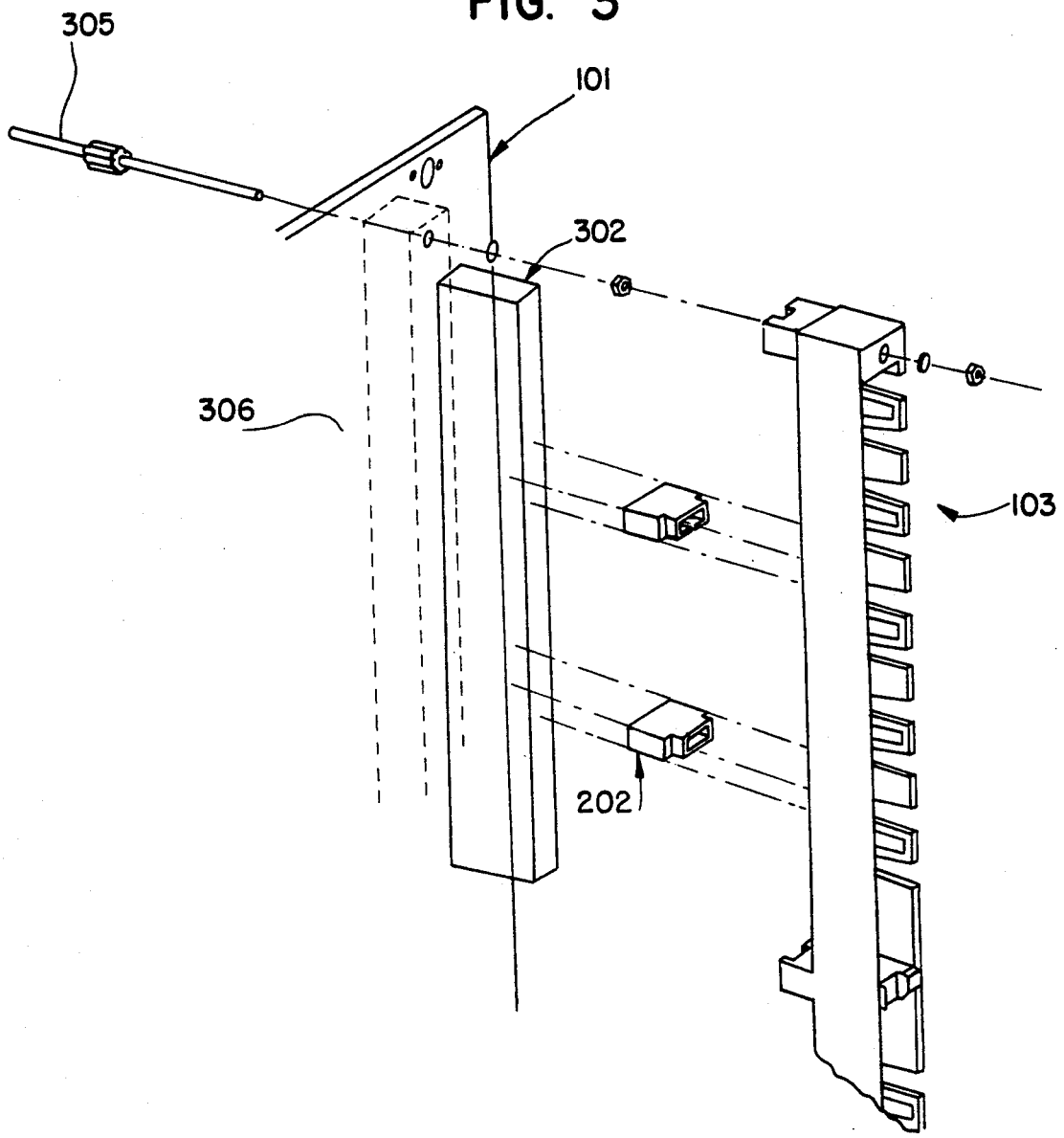
FIG. 3 shows the present invention being installed onto a normal backplane.

In FIG. 2 the present invention is shown from three different angles, an end view 201, a side view 202, and an orthogonal view 203. As can be seen, the present invention is hollow. Shelves 205 rest against the outside edges of the cable shroud 103, while the small end 203, or nipple, rests on the inside of the same cable shroud, thereby providing a small degree of lateral support to the stnadoff. Referring to FIG. 3, one should understand that the PINS 302 emanating from the RECEPTACLE 306 travel through the BACKPLANE 101, then pass through the hollow portion of the present invention. This is not true for the pre-molded standoffs of CABLE SHROUD 103 because GUIDE POST 305 passes through the pre-molded standoffs. The present invention can be placed anywhere between the pre-molded standoffs and in any number; adding another degree of versatility.

The ability to move the SHROUD CENTER STANDOFFS 202 is particularly important when a change must be done to the wiring. Generally, a backplane will have several RECEPTACLES (306) with multiple connections between them; the most common arrangement is that of a "bus" system where all the receptacles are wired in parallel. Under ideal circumstances, all the interconnects between the receptacles are etched into the backplane. However, replacing the entire backplane when a minor change to the backplane must be done is not cost effective. These minor changes are generally implemented through the addition of wire-wrap wires on the backplane. The wire-wrap wires connect the appropriate pins of the appropriate receptacles, thereby making the minor change. A wire-wrap wire could not connect to a pin under a center standoff because of lack of clearance for the wire to wrap around the pin. Additionally, a pin next to a center standoff could not receive a wire-wrap wire for the same reason. Therefore, the SHROUD CENTER STANDOFFS 202, must be movable to provide the greatest flexibility for future changes.

Figure 4:
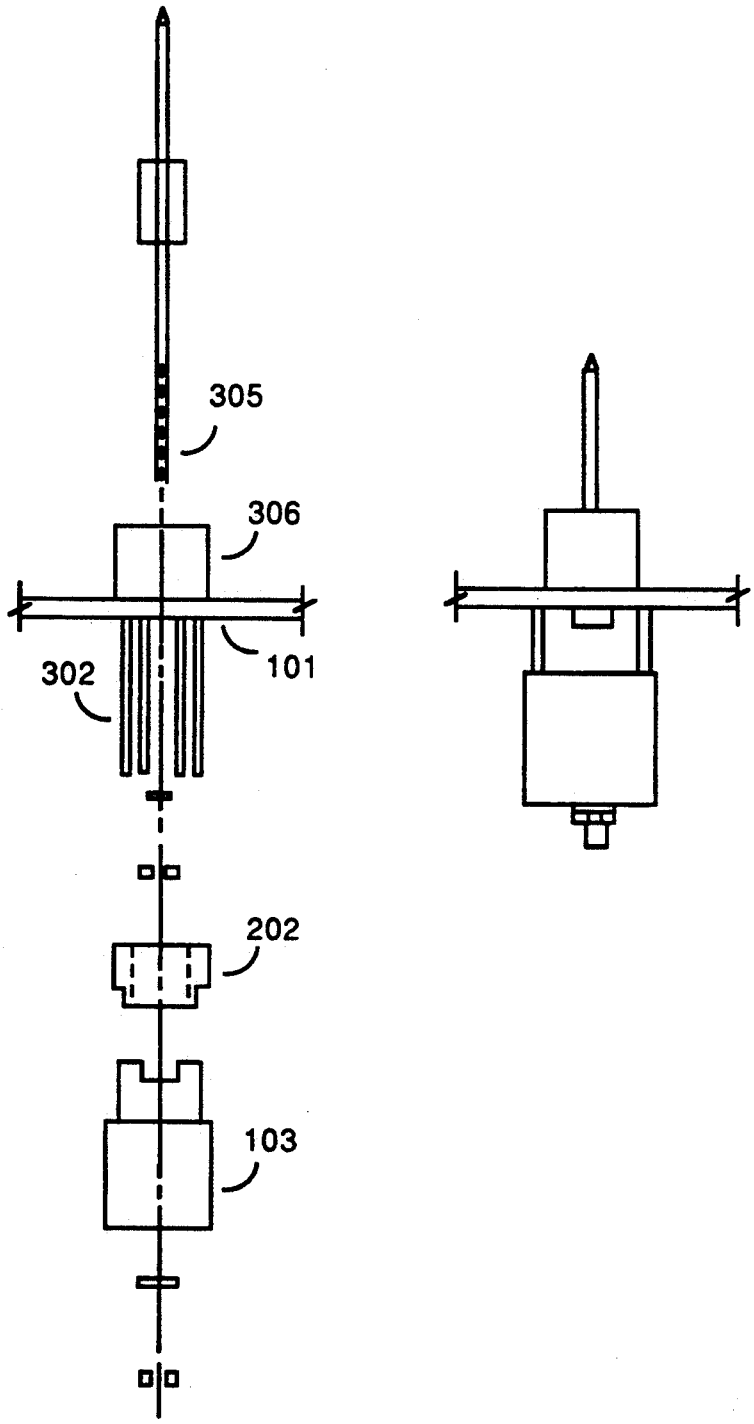
FIG. 4 is a side view showing a complete assembly.

FIG. 4 is an end view giving a more detailed drawing of a complete assembly using the present invention. GUIDE POST 305 serves two primary functions. First it is an alignment point for the insertion of assemblies into RECEPTACLE 306; and second, CABLE SHROUD 103 is held in place by GUIDE POST 305.

Although the preferred embodiment of the invention has been illustrated, and that form described, it is readily apparent to those skilled in the art that various modifications may be made therein without departing from the spirit of the invention or from the scope of the appended claims.

What is claimed is:

1. A movable standoff for maintaining a distance between a backplane and a shroud, said backplane having a front side and rear side, at least one receptacle attached to said front side of said backplane, said at least one receptacle having a plurality of pins that pass from said front side of said backplane to said rear side of said backplane, additionally said pins pass through said shroud, said movable standoff comprising:

a first end and a second end, said second end being parallel to said first end and separated from said first end by said distance;

an orifice extending from said first end to said second end, said orifice having a longitudinal axis, said longitudinal axis being perpendicular to said first end and said second end of said movable standoff, said pins of said at least one receptacle pass through said orifice; and said first end rests against said back side of said backplane, said shroud rests against said second end.

2. A movable standoff as claimed in claim 1, said second end of said movable standoff being smaller than said first end, when said second end rests against said shroud, said second end restricts lateral movement of said movable standoff.

3. A movable standoff arrangement for maintaining a distance between a backplane and a shroud, said backplane having a front side and rear side, said movable standoff arrangement comprising:

at least one receptacle attached to said front side of said backplane, said at least one receptacle having a plurality of pins, said pins pass from said front side of said backplane to said rear side of said backplane, additionally, said pins pass through said shroud;

a standoff having a first end and a second end, said second end of said standoff being parallel to said first end of said standoff and separated from said first end by said distance;

an orifice extending from said first end of said standoff to said second end of said standoff, said orifice having a longitudinal axis, said longitudinal axis being perpendicular to said first end of said standoff and said second end of said standoff, said pins of said at least one receptacle pass through said orifice; and said first end of said standoff rests against said back side of said backplane, said shroud rests against said second end of said standoff.

4. A movable standoff as claimed in claim 3, said second end of said standoff being smaller than said first end of said standoff, when said second end of said standoff restricts lateral movement of said movable standoff arrangement.

* * * * *